US007746283B2

(12) United States Patent
Petropoulos

(10) Patent No.: US 7,746,283 B2
(45) Date of Patent: Jun. 29, 2010

(54) RADIO FREQUENCY IDENTIFICATION (RFID) ANTENNA ASSEMBLIES WITH FOLDED PATCH-ANTENNA STRUCTURES

(75) Inventor: Athanasios Petropoulos, Nashua, NH (US)

(73) Assignee: Laird Technologies, Inc., Chesterfield, MO (US)

( * ) Notice: Subject to any disclaimer, the term of this patent is extended or adjusted under 35 U.S.C. 154(b) by 344 days.

(21) Appl. No.: 11/830,503

(22) Filed: Jul. 30, 2007

(65) Prior Publication Data

US 2008/0284656 A1 Nov. 20, 2008

Related U.S. Application Data

(60) Provisional application No. 60/930,553, filed on May 17, 2007.

(51) Int. Cl.
*H01Q 13/10* (2006.01)

(52) U.S. Cl. ..... 343/770; 343/700 MS

(58) Field of Classification Search ..... 343/700 MS, 343/702, 770, 846, 767
See application file for complete search history.

(56) References Cited

U.S. PATENT DOCUMENTS 6,008,762 A * 12/1999 Nghiem ..... 343/700 MS
6,147,649 A * 11/2000 Ivrissimtzis et al. ... 343/700 MS
6,239,762 B1 5/2001 Lier
6,304,226 B1 10/2001 Brown et al.
6,373,446 B2 4/2002 Apostolos
6,545,647 B1 4/2003 Sievenpiper et al.
6,618,016 B1 9/2003 Hannan et al.
6,680,704 B2 * 1/2004 Cassel et al. ..... 343/700 MS
6,911,939 B2 * 6/2005 Carson et al. ..... 343/700 MS
6,995,711 B2 * 2/2006 Killen et al. ..... 343/700 MS
7,019,705 B2 3/2006 Pfletschinger et al.
7,057,564 B2 * 6/2006 Tsai et al. ..... 343/700 MS
7,064,714 B2 6/2006 Lafleur
7,095,373 B2 * 8/2006 Aikawa et al. ..... 343/700 MS
7,132,990 B2 * 11/2006 Stenger et al. ..... 343/754
7,161,538 B2 1/2007 Zhang et al.
2004/0021606 A1 2/2004 Shigihara
2005/0116875 A1 6/2005 Yuanzhu et al.

(Continued)

FOREIGN PATENT DOCUMENTS

EP 1178568 2/2002

(Continued)

*Primary Examiner*—Huedung Mancuso
(74) *Attorney, Agent, or Firm*—Harness, Dickey & Pierce, P.L.C.

(57) ABSTRACT

Exemplary embodiments are provided of RFID antenna assemblies having folded patch-antenna structures and that are configured with circular polarization or dual linear polarization. An antenna assembly may generally include two folded patch-antenna structures oriented generally perpendicularly to each other. Each folded patch may create a linear polarization wave. When each folded patch is fed independently, the antenna assembly radiates two independent waves that are perpendicularly polarized to each other, therefore providing a dual polarized antenna. In other embodiments, the antenna assembly may include two folded patch-antenna structures again oriented generally perpendicularly to each other. By feeding each folded patch with a 90-degree phase delay between them, a circular polarization wave is radiated. A power divider network may be used to feed the two folded patches with the 90-degree phase delay. The two folded patches may be integrated so as to form a cavity or housing for a printed circuit board.

33 Claims, 8 Drawing Sheets

U.S. PATENT DOCUMENTS

| | | | |
|---|---|---|---|
| 2005/0140552 | A1 | 6/2005 | Lafleur |
| 2006/0139223 | A1 | 6/2006 | Li et al. |
| 2006/0284778 | A1 | 12/2006 | Sanford et al. |
| 2007/0085751 | A1 | 4/2007 | Kai et al. |

FOREIGN PATENT DOCUMENTS

| | | |
|---|---|---|
| WO | WO2007/032690 | 3/2007 |

* cited by examiner

| Megahertz (MHz) | Decibels (Db) |
|---|---|
| 870 | 2.653 |
| 875 | 2.567 |
| 880 | 2.451 |
| 885 | 2.374 |
| 890 | 2.297 |
| 895 | 2.151 |
| 900 | 1.916 |
| 905 | 1.671 |
| 910 | 1.4 |
| 915 | 1.087 |
| 920 | 0.879 |
| 925 | 0.875 |
| 930 | 1.179 |
| 935 | 1.509 |
| 940 | 1.839 |
| 945 | 2.142 |
| 950 | 2.406 |

Fig. 5B

| Datapoint | Megahertz (MHz) | VSWR |
|---|---|---|
| 1 | 902 | 1.2286 |
| 2 | 915 | 1.2343 |
| 3 | 928 | 1.2095 |

Fig. 6B

RADIO FREQUENCY IDENTIFICATION (RFID) ANTENNA ASSEMBLIES WITH FOLDED PATCH-ANTENNA STRUCTURES

CROSS-REFERENCE TO RELATED APPLICATION

This application claims the benefit of U.S. Provisional Application No. 60/930,553 filed May 17, 2007. The disclosure of the above application is incorporated herein by reference.

FIELD

The present disclosure relates to RFID antenna assemblies with folded patch-antennas and that have circular polarization or dual linear polarization.

BACKGROUND

The statements in this section merely provide background information related to the present disclosure and may not constitute prior art.

Radio-frequency identification (RFID) generally refers to the automatic identification method using radio waves and that relies on storing and remotely retrieving data from devices called RFID tags or transponders. RFID readers are the devices used to read the information or data in the RFID tag. The RFID tag may be attached to or incorporated into various things, such as commercial products, animals, people, etc.

RFID tags may be chip-based and contain antennas and integrated circuits. The particular antenna used for an RFID tag is usually affected by the intended application and the frequency of operation. To this end, some RFID tags include patch-antennas. RFID tag antennas are relatively low power antennas configured to obtain enough microwave power from a more powerful RFID reader antenna to "charge" an integrated circuit of the RFID tag. The integrated circuit keeps or stores information about the tagged product, animal, person, etc. RFID tag antennas are designed to work with their specific integrated circuits by matching the RFID tag antennas to the high impedance of their integrated circuits.

In comparison, RFID reader antennas are more complicated antennas than RFID tag antennas. For example, RFID reader antennas have much higher power requirements and are circularly polarized. Conversely, RFID tag antennas are fairly inexpensive antennas (e.g., antennas printed on plastic sheets). RFID tag antennas also may have much simpler polarization requirements (e.g., linear polarization) compared to the polarization requirements for RFID reader antennas (e.g., circular polarization).

SUMMARY

According to various aspects, exemplary embodiments are provided of RFID antenna assemblies having folded patch-antenna structures and that are configured with circular polarization or dual linear polarization. In some embodiments, the antenna assembly generally includes two folded patch-antenna structures oriented generally perpendicularly to each other. Each folded patch creates a linear polarization wave. If each folded patch is fed independently, the antenna assembly radiates two independent waves that are perpendicularly polarized to each other. Therefore, a dual polarized antenna may be realized with these embodiments. In some other embodiments, the antenna assembly includes two folded patch-antenna structures again oriented generally perpendicularly to each other. By feeding each folded patch with a 90-degree phase delay between them, a circular polarization wave is radiated. In these exemplary embodiments, a power divider network may be used to feed the two folded patches with the 90-degree phase delay. The two folded patches may be integrated so as to form a cavity or housing for a printed circuit board. The effective dielectric of the folded patches may be close to one, thus making for very consistent and efficient antenna performance.

In one exemplary embodiment, an antenna assembly generally includes a folded patch-antenna structure. The folded patch-antenna structure may include first and second folded patch-antennas and a plurality of slots. During operation, the antenna assembly radiates through the slots. The slots cooperate to create a first slot array for a first polarization associated with the first folded patch-antenna and a second slot array for a second polarization associated with the second folded patch-antenna.

Another exemplary embodiment includes a radio-frequency identification (RFID) reader. The RFID reader may be suitable for use with an RFID tag of an RFID system. The RFID reader may generally include first and second folded patch-antennas oriented generally perpendicular to each other and operable for communicating with an antenna of the RFID tag.

In another exemplary embodiment, an antenna assembly generally includes a patch-antenna structure and a printed circuit board microstrip network disposed within a space defined generally by the patch-antenna structure for feeding the patch-antenna structure. The printed circuit board microstrip network may be configured so as to provide a relative compact broadband mechanism for feeding the patch-antenna structure. The patch-antenna structure may include first and second pairs of generally opposing end portions and first and second elongate medial portions. The elongate medial portions may be oriented generally perpendicular to each other and extend between the corresponding first or second pair of end portions. Each end portion may have upward portion extending upwardly relative to the corresponding first or second elongate medial portion. Each end portion may also have a lateral portion extending inwardly at an angle of about ninety degrees relative to the upward portion partially over the corresponding first or second elongate medial portion. The lateral portions of the first pair of end portions may define a first pair of slots. And, the lateral portions of the second pair of end portions may define a second pair of slots. During operation, the antenna assembly may radiate through the first and second pairs of slots with the each pair of slots cooperating to create an array.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 5B is a table setting forth the axial ratio (decibels) at the various frequencies (in Megahertz) shown in the line graph of FIG. 5A;

FIG. 6B is a table setting forth the VSWR and frequency (in Megahertz) for the three datapoints shown in the line graph of FIG. 6A.

DETAILED DESCRIPTION

Figure 1:
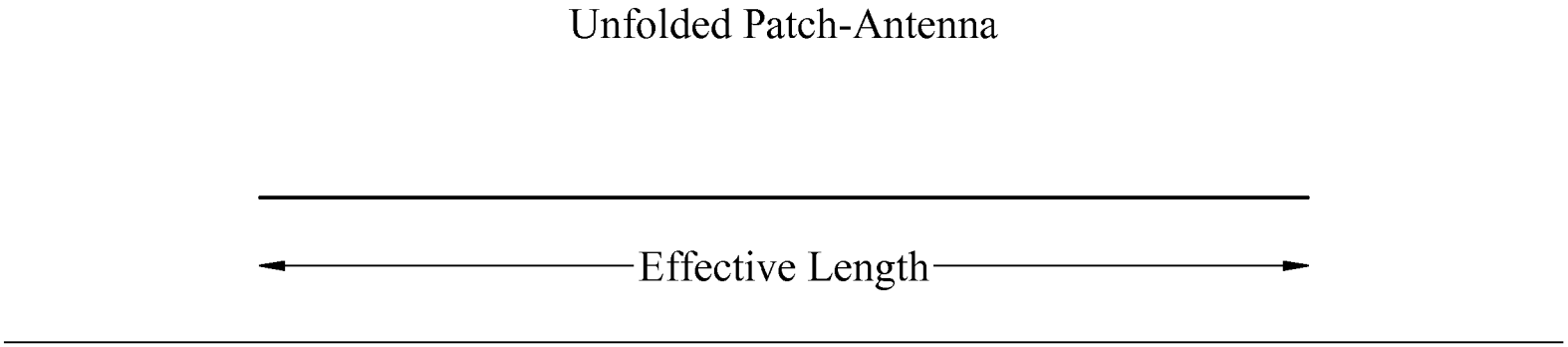
FIG. 1 illustrates a conventional "unfolded" patch-antenna having an effective length.

The following description is merely exemplary in nature and is not intended to limit the present disclosure, application, or uses. It should be understood that throughout the drawings, corresponding reference numerals indicate like or corresponding parts and features.

Figure 2:
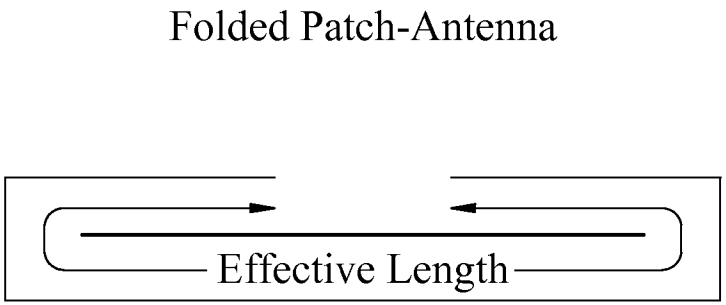
FIG. 2 illustrates a folded patch-antenna according to an exemplary embodiment having an effective length, where the folding provides the folded patch-antenna with a smaller footprint as compared to the conventional "unfolded" patch-antenna having the same effective length shown in FIG. 1.

As disclosed herein, various exemplary embodiments provide RFID antenna assemblies having folded patch-antenna structures and that are configured with a circular polarization or dual linear polarization. In some embodiments, the RFID antenna assemblies include a folded patch-antenna structure where the folding reduces the footprint of the antenna. In some embodiments, the folded patch-antenna structure (e.g., FIG. 2) has an overall length reduced by fifty percent or more as compared to an unfolded patch-antenna structure (e.g., FIG. 1, etc.) having the same effective length equal to that of the folded patch-antenna structure. In some embodiments, the area of the folded patch-antenna can be one quarter or less of the area of an unfolded patch-antenna. In one particular embodiment, an antenna assembly is configured with a footprint of about 0.25 wavelength×0.25 wavelength ($\lambda/4\times\lambda/4$) or less.

Plus, various embodiments also are configured for use without requiring any ground plane. In other embodiments, the antenna assembly may be operated with a relatively small ground plane, for example, to improve gain (directivity) and front-to-back (F/B) ratio. By way of example, some embodiments may be used with a ground plane that is smaller than 0.5 wavelength×0.5 wavelength ($\lambda/2\times\lambda/2$), such as a ground plane with an area of 0.25 wavelength×0.25 wavelength ($\lambda/4\times\lambda/4$) or less. By way of comparison, some existing antennas require a ground plane having a minimum area of 0.5 wavelength×0.5 wavelength ($\lambda/2\times\lambda/2$).

Various embodiments also are configured for broadband operation with a broad axial bandwidth. For example, various embodiments disclosed herein include RFID antenna assemblies having an axial ratio bandwidth in excess of five percent. Other embodiments include RFID antenna assemblies having a three percent axial ratio bandwidth for the 902 MHz to 928 MHz band, although axial ratio bandwidth may be much larger. Moreover, some embodiments include RFID antenna assemblies that may be manufactured in a very consistent manner. By way of comparison only, typical axial ratio bandwidths for single feed, small profile, low height antennas are in the order of one percent. Plus, these narrowband designs are not usually very consistent and usually need to be manually tuned to meet axial ratio requirements.

In some embodiments, an antenna assembly includes two folded patch-antenna structures oriented generally perpendicularly to each other. Each folded patch creates a linear polarization wave. When each folded patch is fed independently, the antenna assembly radiates two independent waves that are perpendicularly polarized to each other. Therefore, a dual polarized antenna may be realized with these embodiments.

In some other embodiments, an antenna assembly includes two folded patch-antenna structures again oriented generally perpendicularly to each other. By feeding each folded patch with a 90-degree phase delay between them, a circular polarization wave is radiated. In these exemplary embodiments, a power divider network may be used to feed the two folded patches with the 90-degree phase delay. The two folded patches may be integrated so as to form a cavity or housing for a printed circuit board. The effective dielectric of the folded patches may be close to one, thus making for very consistent and efficient antenna performance. Other aspects of the present disclosure relate to methods of making or manufacturing antennas. Further aspects of the present disclosure relate to methods of using antennas.

Figure 3:
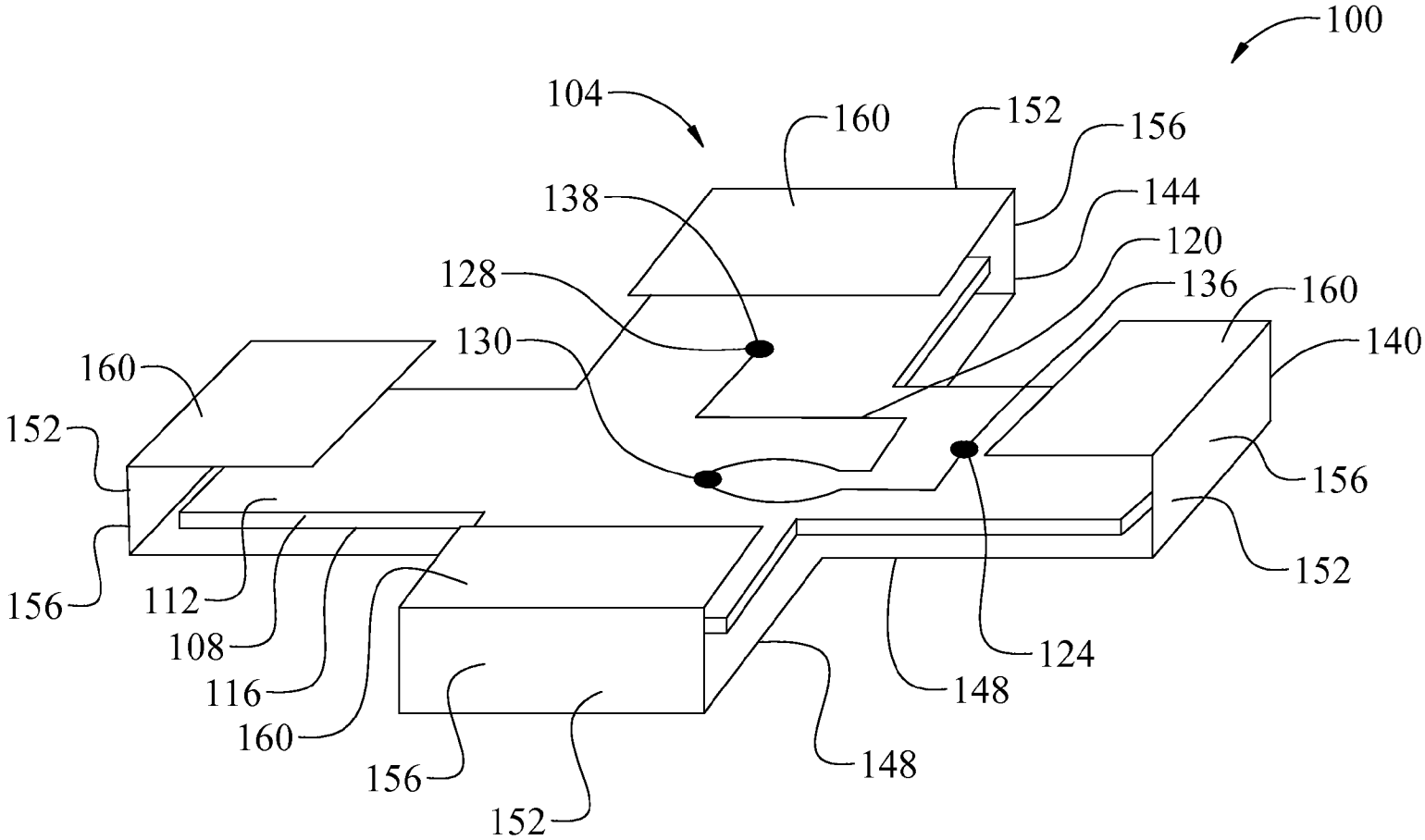
FIG. 3 is a perspective view of a circular polarized antenna assembly including two folded patch-antennas oriented generally perpendicular to each other and that are fed so as to produce circularly polarized waves.
Figure 4:
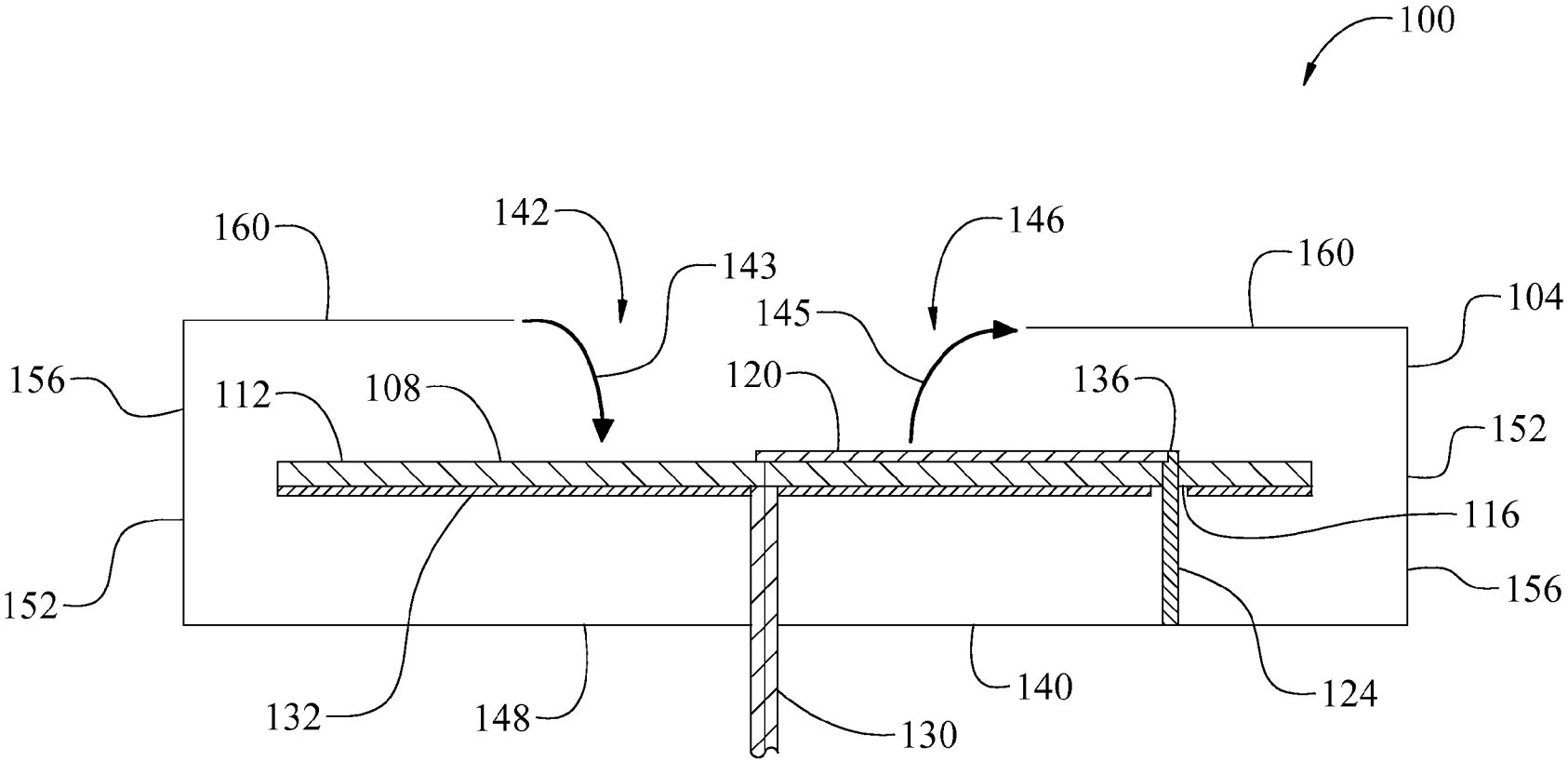
FIG. 4 is a partial view of the antenna assembly shown in FIG. 3.

With reference to FIGS. 3 and 4, there is shown an exemplary embodiment of an RFID antenna assembly 100 embodying one or more aspects of the present disclosure. As shown in FIGS. 3 and 4, the RFID antenna assembly 100 includes a folded patch-antenna structure 104 and a printed circuit board (PCB) 108. The PCB 108 includes an upper surface or component side 112 and a lower surface 116. In some embodiments, the PCB 108 is operable as a relatively compact broadband mechanism to feed the folded patch-antenna structure 104.

The antenna assembly 100 also includes a transmission line 120 on the PCB's upper surface or component side 112. In the illustrated embodiment, the transmission line 120 comprises a microstrip line coupled or electrically connected to first and second probes or pins 124 and 128. The probes 124, 128 may be electrically-conductive and generally cylindrical, although other antenna connectors may also be used in other embodiments.

The microstrip line is also coupled or electrically connected to a communication link 130 (e.g., coaxial cable, etc.). As shown in the exemplary embodiment of FIG. 3, a single coaxial cable is coupled or electrically connected to the transmission line 120. The single coaxial cable is generally centrally located (see 130 in FIG. 3) relative to the folded patch-antenna structure 104, but it may also be located elsewhere. In some preferred embodiments, the transmission line 120 may be formed as a meandering circuit trace on the component side 112 of the PCB 108. In the illustrated embodiment, the PCB 108 includes a dielectric substrate or board on which the microstrip line is mounted. Alternatively, the microstrip line could instead be suspended within the cavity formed generally by the folded patch-antennas 140, 144. In which case, the antenna assembly need not include the dielectric substrate, such that the dielectric material would essentially be replaced with air.

With continued reference to FIGS. 3 and 4, a metallization layer or laminate 132 may be provided on or in contact with the lower surface 116 of the PCB 108. The component side 112 of the PCB 108 may also include other pads, traces, etc.

that may be used to accommodate and electrically connect other components of the antenna assembly 100.

The bottom laminate 132 of the PCB 108 may act both as part of the supporting structure of the folded patch antenna structure 104 (e.g., middle ground plane shown in FIG. 2), as well as ground plane for the microstrip line 120. The microstrip line network may act as a power divider to distribute RF power to each folded patch-antenna 140, 144. The microstrip line network may also act as a ninety degree phase delay network, if used for feeding the folded patch-antennas 140, 144 with ninety degree signal delay between them for circular polarization. This network could be a broadband divider, such as a quadrature hybrid, Wilkinson power divider, etc.

The communication link 130 may be coupled to the transmission line 120 for communicating signals to/from the transmission line 120. In some preferred embodiments, the communication link 130 comprises a coaxial line (e.g., coaxial cable, etc.). Alternatively, other suitable communication links may also be employed.

With continued reference to FIGS. 3 and 4, the first probe 124 is connected to a first end portion 136 of the transmission line 120. As shown in FIG. 4, the first probe 124 extends through the substrate of the PCB 108 and also through the metallization layer 132. The first probe 124 is electrically connected to the folded patch-antenna structure 104.

As shown in FIG. 3, the second probe 128 is connected to a second end portion 138 of the transmission line 120. The second probe 128 also extends through the substrate of the PCB 108 and through the metallization layer 132. The second probe 128 is electrically connected to the folded patch-antenna structure 104.

In the illustrated embodiment of FIG. 3, the folded patch-antenna structure 104 includes two folded patch-antennas 140, 144 respectively coupled to and fed by the first and second probes 124 and 128. As shown in FIGS. 3 and 4, a single coaxial cable 130 is coupled or electrically connected to the transmission line 120, for feeding both the first and second folded patch-antennas 140, 144. Alternative embodiments may include more or less than two folded patch-antennas and more or less than one communication link, depending, for example, on the particular end-use for the antenna assembly and type of signals to be received and/or transmitted.

Each folded patch-antenna 140 and 144 have a linear polarization. By feeding the folded patch-antenna 140 and 144 with a ninety-degree phase delay, a circular polarization wave is radiated. By way of example, the exemplary line graph (shown in FIG. 5A) of axial ratio versus frequency 870 MHz to 950 MHz band generally demonstrates how well the circular polarization is for the exemplary antenna assembly 100 shown in FIGS. 3 and 4.

As shown in FIG. 3, each folded patch-antennas 140, 144 includes a medial elongate portion 148 and end portions 152. Each end portion 152 includes a first portion 156 and a second portion 160. The first portion 156 extends upwardly relative to the elongate medial portion 148. The second portion 160 extends laterally relative to the first portion 156 partially over the elongate medial portion 148. In this illustrated embodiment, each first portion 156 is formed (e.g., folded, bent, etc.) upwardly at an angle of about ninety degrees relative to the corresponding medial elongate portion 148. Each second portion 156 is formed (e.g., folded, bent, etc.) at an angle of about ninety degrees relative to the corresponding first portion 156. Alternative configurations (e.g., other bend angles, etc.) may also be used for other applications. For example, other embodiments may include one folded patch and one unfolded patch. As another example, other embodiments may include one or more folded patches having only one folded end portion. Still further embodiments may include a folded patch with end portions having configurations (e.g., fold angles, etc.) different from each other.

The antenna assembly 100 may be operable such that it radiates (e.g., arrows 143 and 145 representing electric fields in FIG. 4) through the slots 142, 146 when radio-frequency (RF) energy is introduced into the cavity formed generally by the folded patch-antennas 140, 144. The RF energy may be applied by way of the communication link 130.

The patch-antenna structure 104 may be configured such that the cavity resonates at a first frequency for RF energy having a first polarization. The slots 142, 146 may radiate or produce linearly polarized radiation associated with the first folded patch-antenna 140. The cavity may resonate at a second frequency for RF energy having a second polarization. The slots 142, 146 may radiate or produce linearly polarized radiation associated with the second folded patch-antenna 144. Additionally, electromagnetic waves may be received by and transmitted from the folded patch-antenna structure 104 through the slots 142, 146.

As shown in FIG. 3, the slots 142, 146 are defined generally between the opposing spaced-apart second end portions 160 of the respective first and second folded patch-antennas 140, 144. The slots 142, 146 may cooperatively create a slot array for each polarization associated with the antenna assembly 100. For example, the slots 142, 146 can cooperatively create a first slot array for a first polarization associated with the first folded patch-antenna 140. And, the slots 142, 146 may also cooperatively create a second slot array for a second polarization associated with the second folded patch-antenna 144.

When the first and second patch-antennas 140, 144 are fed independently, the antenna assembly 100 may radiate dual linearly polarized radiation through the slots 142, 146. But when the first and second patch-antennas 140, 144 are fed with a 90-degree phase delay between them, the antenna assembly 100 may radiate circularly polarized radiation through the slots 142, 146.

An exemplary manufacturing process for making a folded patch-antenna structure for an RFID antenna assembly will now be described for purposes of illustration only. First, a flat pattern profile may be stamped out of a single sheet of material (e.g., sheet metal, etc.). After stamping the flat pattern profile in the piece of material, the material may be folded, bent, or otherwise formed into the configuration of the folded patch-antenna structure 104 shown in FIG. 3. Even though the folded patch-antenna structure 104 may be formed integrally in this example, such is not required for all embodiments. For example, other embodiments may include a patch-antenna structure formed from two or more discrete components that are separately attached to each other, for example, by welding, adhesives, among other suitable methods. Another practical embodiment includes a cavity and four plates (comparable to second end portions 160 in FIG. 3) located at the top of the cavity and mechanically connected to the cavity, for example, by using screws, welding, etc. Alternative configurations (e.g., shapes, sizes, etc.), materials (e.g., laser activated plastics, two-shot molded plastics, etc.), and manufacturing methods (e.g., casting, etc.) may be used for making a folded patch-antenna structure.

Figure 5A:
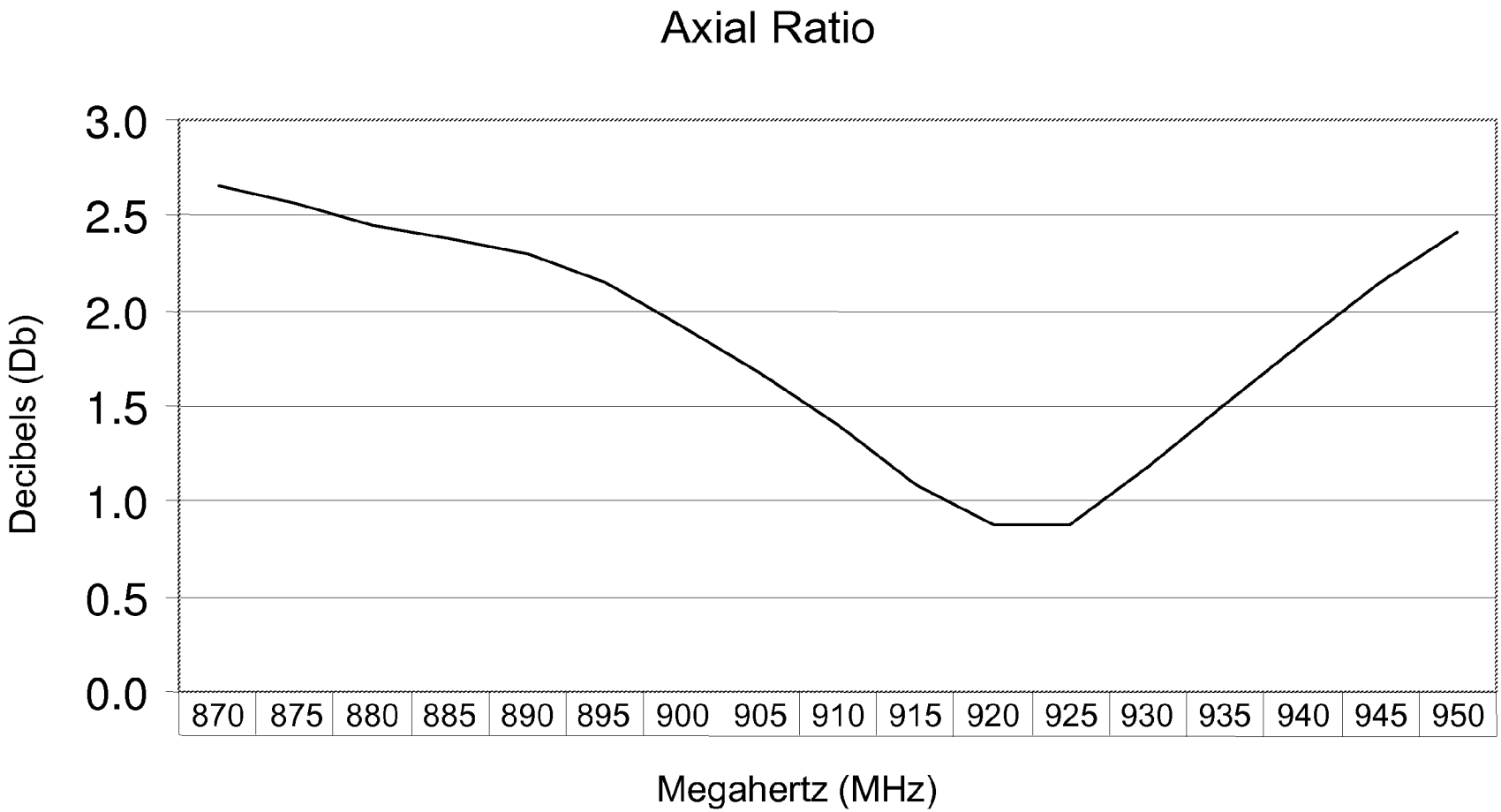
FIG. 5A is an exemplary line graph of axial ratio (in decibels) versus frequency 870 MHz to 950 MHz band for the exemplary antenna assembly shown in FIG. 3, and generally demonstrating how well the circular polarization is for the antenna assembly.
Figure 6A:
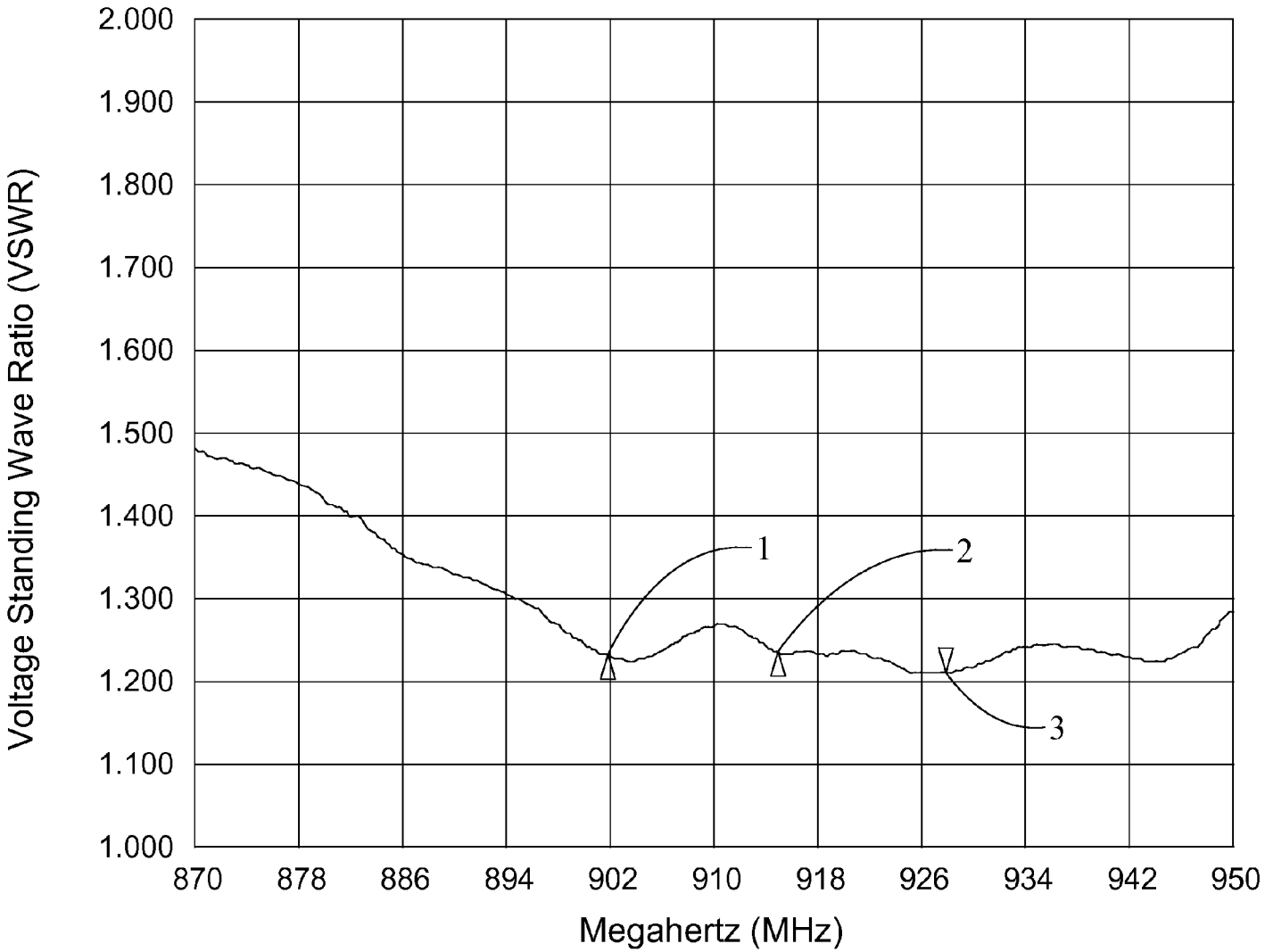
FIG. 6A is an exemplary line graph of voltage standing wave ratio (VSWR) versus frequency 870 MHz to 950 MHz band for the exemplary antenna assembly shown in FIG. 3.
Figure 7:
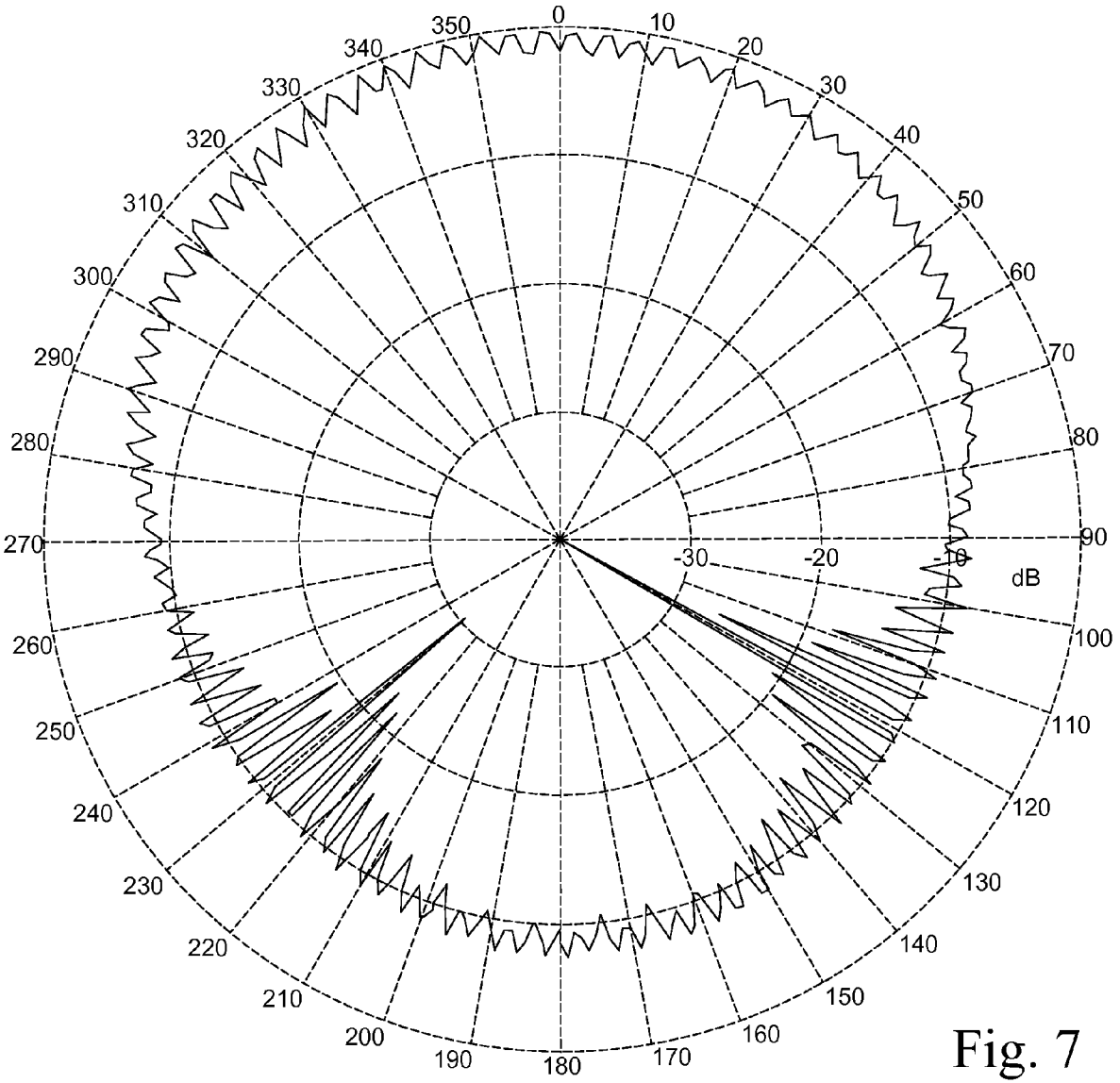
FIG. 7 is an exemplary axial spin radiation pattern at 915 MHz for the exemplary antenna assembly shown in FIG. 3.

FIGS. 5A, 6A, and 7 illustrate exemplary graphs of test data obtained for the exemplary antenna assembly 100 shown in FIG. 3. These graphs and the test data depicted thereby are provided for purposes of illustration only. Accordingly, the scope of the present disclosure should not be limited to only antenna assemblies configured to achieve the results shown in FIGS. 5A, 6A, and 7. Other embodiments may include antenna assemblies configured to have different operational parameters and/or to achieve different results than that shown in FIGS. 5A, 6A, and 7, depending, for example, on the particular end-use of the antenna assembly and type of signals to be received and/or transmitted. For example, FIGS. 5A and 6A show test data for a frequency band from 870 MHz to 950 MHz for purposes of illustration only, as some embodiments disclosed herein are configured and intended for the "900 MHz band" from 902 MHz to 928 MHz.

With further reference to FIG. 5A, there is shown an exemplary line graph of axial ratio versus frequency 870 MHz to 950 MHz band for the exemplary antenna assembly 100 shown in FIG. 3. The data depicted in this graph (FIG. 5A) generally demonstrates how well the circular polarization is for the antenna assembly 100. FIG. 5A also shows that the axial ratio below three decibels over the entire 870 MHz to 950 MHz band, which is a fairly wide band axial ratio for such a small size antenna. FIG. 5A further shows in excess of four percent two decibel axial ratio bandwidth, which is extremely high for such a small size antenna. The axial ratio performance is related to (a) the very good isolation between the two folded patches, and (b) the lack of surface waves because electric fields are mostly in air dielectric.

FIG. 6A is an exemplary line graph of voltage standing wave ratios (VSWR) versus frequency 870 MHz to 950 MHz band for the exemplary antenna assembly 100 shown in FIG. 3. The data depicted in the graph (FIG. 6A) generally demonstrates the ability of the antenna assembly 100 to achieve a VSWR that is extremely consistent and low given the particular size of the antenna assembly 100.

FIG. 7 is an exemplary axial spin radiation pattern at 915 MHz for the exemplary antenna assembly 100 shown in FIG. 3. The peak linear gain shown by FIG. 7 is high for such a small size antenna and is due to its high radiation efficiency. The efficiency is high because the dielectric losses are small (most of the antenna electric fields are in air dielectric).

Collectively, FIGS. 5 through 7 generally demonstrate that the antenna assembly 100 when configured for use as a 900 MHz RFID antenna may have superior radiation and polarization characteristics (e.g., relatively low axial ratio, etc.) and radiation efficiency.

Because the patch-antenna structures in some embodiments do not use dielectric materials, the antenna assemblies are able to be reduced in size and/or be manufactured relatively cheaply. By eliminating (or at least reducing the need for) dielectric materials, it is also possible to eliminate some of the drawbacks associated with the use of dielectrics. For example, dielectrics are typically relatively expensive and also may be a source of inconsistency due to tolerances associated with the thickness of the dielectric material and the dielectric constant, where such inconsistencies may change the tuning and axial ratio of antennas. Dielectrics may also have deleterious effects on efficiency of the antennas due to surface modes and dielectric losses. Accordingly, various embodiments disclosed herein provide antenna assemblies that may be manufactured consistently and at relatively low costs in large volumes due to their consistency, relatively low manufacturing costs, and relatively few parts.

Various embodiments disclosed herein include antenna assemblies that are rugged and suitable for RFID environments, versatile, and relatively easily tunable to meet RFID standards in different countries. In some embodiments, only two components (e.g., the length of the plates or second portions 160 and/or length of the trace 120 on the PCB 108) of the antenna assembly needs to be changed in order to satisfy the different RFID standards, while the other components are standard and would not need to be changed for the different RFID bands.

It should be noted that embodiments and aspects of the present disclosure may be used in a wide range of antenna applications, such as RFID applications, antennas mounted on mobile platforms (e.g., automobiles, motorcycles, ships, airplanes, etc.) for receiving satellite signals (e.g., Satellite Digital Audio Radio Services (SDARS), Global Positioning System (GPS), cellular signals, etc.) and/or terrestrial signals, among other applications. Moreover, the embodiments can be used for linear or dual linear polarization applications. Accordingly, the scope of the present disclosure should not be limited to only one specific form/type of antenna assembly.

Certain terminology is used herein for purposes of reference only, and thus is not intended to be limiting. For example, terms such as "upper", "lower", "above", "below", "top", "bottom", "upward", and "downward" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna assembly comprising a folded patch-antenna structure including a first folded patch-antenna, a second folded patch-antenna, and a plurality of slots, whereby the antenna assembly radiates through the slots and the slots cooperate to create a first slot array for a first polarization associated with the first folded patch-antenna and a second slot array for a second polarization associated with the second folded patch-antenna, wherein each of the first and second folded patch-antennas includes:

an elongate medial portion; and spaced-apart end portions each having an upward portion extending upwardly relative to the elongate medial portion and a lateral portion extending laterally relative to the upward portion partially over the elongate medial portion, and wherein:

the first slot array is defined by the lateral portions of the first folded patch-antenna and a ground disposed within a space defined by the folded patch-antenna structure; and the second slot array is defined by the lateral portions of the second folded patch-antenna and the ground.

2. The antenna assembly of claim 1, wherein the first and second folded patch-antennas are oriented generally perpendicular relative to each other.

3. The antenna assembly of claim 1, wherein the first folded patch-antenna radiates a linear polarization through the first slot array, and wherein the second folded patch-antenna radiates a linear polarization through the second slot array.

4. The antenna assembly of claim 1, wherein the first and second folded patch-antennas are fed with a ninety-degree phase delay therebetween such that circularly polarized radiation is radiated through the slots.

5. The antenna assembly of claim 4, further comprising a power divider network configured for feeding the first and second folded patch-antennas.

6. The antenna assembly of claim 1, wherein the first and second folded patch-antennas are fed independently from each other such that the antenna assembly radiates independent waves perpendicularly polarized to each other, thereby providing dual linear polarization.

7. The antenna assembly of claim 1, wherein the effective dielectric of the first and second folded patch-antennas is about one.

8. An antenna assembly comprising:

a folded patch-antenna structure including a first folded patch-antenna, a second folded patch-antenna, and a plurality of slots, whereby the antenna assembly radiates through the slots and the slots cooperate to create a first slot array for a first polarization associated with the first folded patch-antenna and a second slot array for a second polarization associated with the second folded patch-antenna;

a substrate having a lower substrate surface and an upper substrate surface;

a transmission line coupled to the upper substrate surface;

a metallization coupled to the lower substrate surface and operable as a ground plane for the transmission line and as supporting structure for the patch-antenna structure, and wherein:

the first slot array is defined by portions of the first folded patch-antenna and the metallization; and the second slot array is defined by portions of the second folded patch-antenna and the metallization.

9. The antenna assembly of claim 1, wherein each upward portion is folded upwardly at an angle of about ninety degrees relative to the corresponding medial portion, and wherein each lateral portion is folded at an angle of about ninety degrees relative to the corresponding upward portion.

10. The antenna assembly of claim 1, wherein the antenna assembly is tunable to different frequency bands of operation by only changing a length of the lateral portions.

11. A radio-frequency identification (RFID) reader comprising the antenna assembly of claim 1.

12. The antenna assembly of claim 1, further comprising a printed circuit board microstrip network disposed within a space defined by the folded patch-antenna structure for feeding the first and second folded patch-antennas.

13. The antenna assembly of claim 1, wherein the antenna assembly further comprises:

a substrate having a lower substrate surface and an upper substrate surface;

a transmission line coupled to the upper substrate surface; and a metallization coupled to the lower substrate surface and operable as a ground plane for the transmission line and as supporting structure for the patch-antenna structure.

14. The antenna assembly of claim 8, wherein each of the first and second folded patch-antennas includes:

an elongate medial portion; and spaced-apart end portions each having an upward portion extending upwardly relative to the elongate medial portion and a lateral portion extending laterally relative to the upward portion partially over the elongate medial portion, and wherein:

the first slot array is defined by the lateral portions of the first folded patch-antenna and the metallization disposed within a space defined by the folded patch-antenna structure; and the second slot array is defined by the lateral portions of the second folded patch-antenna and metallization.

15. The antenna assembly of claim 14, further comprising a first electrically-conductive generally cylindrical probe coupled to the first folded patch-antenna structure and the transmission line, and a second electrically-conductive generally cylindrical probe coupled to the second folded patch-antenna structure and the transmission line, wherein the first and second probes run from the respective first and second folded patch-antennas through the metallization and the substrate to the transmission line.

16. The antenna assembly of claim 12, wherein the printed circuit board microstrip network is operable for feeding the first and second folded patch-antennas with a ninety-degree phase delay therebetween such that circularly polarized radiation is radiated through the pair of slots of each folded patch-antenna.

17. The antenna assembly of claim 1, further comprising a single coaxial cable for feeding the first and second folded patch-antennas.

18. A radio-frequency identification (RFID) reader suitable for use with an RFID tag of an RFID system, the RFID reader comprising first and second folded patch-antennas oriented generally perpendicular to each other and operable for communicating with an antenna of the RFID tag, wherein the first and second folded patch-antennas have spaced-apart end portions and slots cooperating to create a first slot array for a first polarization associated with the first folded patch-antenna and a second slot array for a second polarization associated with the second folded patch-antenna, wherein each of the first and second folded patch-antennas includes:

an elongate medial portion; and the end portions each include an upward portion extending upwardly relative to the elongate medial portion and a lateral portion extending laterally relative to the upward portion partially over the elongate medial portion, and wherein:

the first slot array includes a first pair of slots defined by the lateral portions of the first folded patch-antenna and a ground disposed within a space defined by the first and second folded patch-antennas; and the second slot array includes a second pair of slots defined by the lateral portions of the second folded patch-antenna and the ground.

19. An RFID system comprising the RFID reader of claim 18 and an RFID tag, the RFID tag including an antenna and an integrated circuit operable for storing information, the tag antenna operable for receiving energy radiated by the RFID reader for powering the integrated circuit, the RFID reader operable for transmitting a signal to the RFID tag and for receiving a response to the signal from the RFID tag to recognize information of the RFID tag.

20. The RFID reader of claim 18, wherein each upward portion is folded upwardly at an angle of about ninety degrees relative to the corresponding medial portion, and wherein each lateral portion is folded at an angle of about ninety degrees relative to the corresponding upward portion.

21. The RFID reader of claim 18, wherein the first and second folded patch-antennas are fed with a 90-degree phase delay therebetween such that circularly polarized radiation is radiated.

22. The RFID reader of claim 18, wherein the first and second folded patch-antennas are fed independently from each other such that the antenna assembly radiates independent waves perpendicularly polarized to each other, thereby providing dual linear polarization.

23. The RFID reader of claim 18, further comprising a single coaxial cable for feeding the first and second folded patch-antennas.

24. A radio-frequency identification (RFID) reader suitable for use with an RFID tag of an RFID system, the RFID reader comprising:

first and second folded patch-antennas oriented generally perpendicular to each other and operable for communicating with an antenna of the RFID tag;

a ground and a printed circuit board microstrip network disposed within a space defined by the first and second folded patch-antennas for feeding the first and second folded patch-antennas, and wherein:

a first pair of slots is defined by portions of the first folded patch-antenna and the ground; and a second pair of slots is defined by portions of the second folded patch-antenna and the ground.

25. The RFID reader of claim 24, wherein the first and second pair of slots cooperate to create a first slot array for a first polarization associated with the first folded patch-antenna and a second slot array for a second polarization associated with the second folded patch-antenna.

26. The RFID reader of claim 24, wherein the first and second folded patch-antennas have spaced-apart end portions and the first and second pair of slots cooperate to create a first slot array for a first polarization associated with the first folded patch-antenna and a second slot array for a second polarization associated with the second folded patch-antenna.

27. The RFID reader of claim 26, wherein each of the first and second folded patch-antennas includes:

an elongate medial portion; and the end portions each include an upward portion extending upwardly relative to the elongate medial portion and a lateral portion extending laterally relative to the upward portion partially over the elongate medial portion, and wherein:

the first slot array includes the first pair of slots defined by the lateral portions of the first folded patch-antenna and the ground disposed within a space defined by the first and second folded patch-antennas; and the second slot array includes the second pair of slots defined by the lateral portions of the second folded patch-antenna and the ground.

28. An antenna assembly comprising:

a patch-antenna structure including first and second pairs of generally opposing end portions and first and second elongate medial portions oriented generally perpendicular to each other and extending between the corresponding first or second pair of end portions, each end portion having an upward portion extending upwardly relative to the corresponding first or second elongate medial portion and a lateral portion extending inwardly at an angle of about ninety degrees relative to the upward portion partially over the corresponding first or second elongate medial portion, the lateral portions of the first pair of end portions defining a first pair of slots, the lateral portions of the second pair of end portions defining a second pair of slots, whereby the antenna assembly radiates through the first and second pairs of slots with each pair of slots cooperating to create a slot array;

a printed circuit board microstrip network disposed within a space defined generally by the folded patch-antenna structure for feeding the patch-antenna structure;

a substrate having a lower substrate surface and an upper substrate surface;

a transmission line coupled to the upper substrate surface; and a metallization coupled to the lower substrate surface and operable as a ground plane for the transmission line and as supporting structure for the patch-antenna structure;

the first pair of slots is defined between the metallization and the lateral portions of the first pair of end portions; and the second pair of slots is defined between the metallization and the lateral portions of the second pair of end portions.

29. The antenna assembly of claim 28, further comprising a single coaxial cable for feeding the patch-antenna structure.

30. The antenna assembly of claim 28, further comprising:

a first electrically-conductive generally cylindrical probe coupled to the first elongate medial portion and the transmission line, the first probe extending from the first elongate medial portion through the metallization and the substrate of the circuit board to the transmission line; and a second electrically-conductive generally cylindrical probe coupled to the second elongate medial portion and the transmission line, the second probe extending from the second elongate medial portion through the metallization and the substrate of the circuit board to the transmission line.

31. The antenna assembly of claim 28, wherein the patch-antenna structure comprises first and second folded patch-antennas respectively defining the first and second elongate medial portions and the first and second pairs of end portions.

32. The antenna assembly of claim 28, wherein each of the first and second folded patch-antennas creates a linear polarization, and wherein the first and second folded patch-antennas are fed independently from each other such that the antenna assembly radiates independent waves perpendicularly polarized to each other, thereby providing dual linear polarization.

33. The antenna assembly of claim 28, wherein the first and second folded patch-antennas are fed with a ninety-degree phase delay therebetween such that circularly polarized radiation is radiated through the pair of slots of each folded patch-antenna.

* * * * *